US009435492B2

(12) United States Patent
Heikman

(10) Patent No.: US 9,435,492 B2
(45) Date of Patent: Sep. 6, 2016

(54) LED LUMINAIRE WITH IMPROVED THERMAL MANAGEMENT AND NOVEL LED INTERCONNECTING ARCHITECTURE

(71) Applicant: Cree, Inc., Durham, NC (US)

(72) Inventor: Sten Heikman, Goleta, CA (US)

(73) Assignee: Cree, Inc., Durham, NC (US)

( * ) Notice: Subject to any disclaimer, the term of this patent is extended or adjusted under 35 U.S.C. 154(b) by 142 days.

(21) Appl. No.: 14/206,825

(22) Filed: Mar. 12, 2014

(65) Prior Publication Data

US 2014/0268771 A1 Sep. 18, 2014

Related U.S. Application Data

(60) Provisional application No. 61/802,079, filed on Mar. 15, 2013.

(51) Int. Cl.

| | |
|---|---|
| ***F21V 3/00*** | (2015.01) |
| ***F21V 29/00*** | (2015.01) |
| ***F21S 4/00*** | (2016.01) |
| ***F21K 99/00*** | (2016.01) |
| ***F21V 29/506*** | (2015.01) |
| *F21Y 101/02* | (2006.01) |
| *F21Y 103/02* | (2006.01) |
| *F21Y 111/00* | (2016.01) |
| *F21V 29/70* | (2015.01) |

(52) U.S. Cl.

CPC ..... *F21K 9/135* (2013.01); *F21K 9/137* (2013.01); *F21V 29/004* (2013.01); *F21V 29/506* (2015.01); *F21V 29/70* (2015.01); *F21Y 2101/02* (2013.01); *F21Y 2103/022* (2013.01); *F21Y 2111/002* (2013.01); *F21Y 2111/005* (2013.01)

(58) Field of Classification Search

CPC .. F21K 9/135; F21V 29/004; F21Y 2101/02; F21Y 2111/002; F21Y 2103/02; F21Y 2103/022

See application file for complete search history.

(56) References Cited

U.S. PATENT DOCUMENTS

| | | | |
|---|---|---|---|
| 3,581,162 | A | 5/1971 | Wheatley |
| 5,463,280 | A | 10/1995 | Johnson |
| 5,561,346 | A | 10/1996 | Byrne |
| 5,585,783 | A | 12/1996 | Hall |
| 5,655,830 | A | 8/1997 | Ruskouski |
| 5,688,042 | A | 11/1997 | Madadi et al. |
| 5,806,965 | A | 9/1998 | Deese |
| 5,947,588 | A | 9/1999 | Huang |
| 5,949,347 | A | 9/1999 | Wu |
| 6,220,722 | B1 | 4/2001 | Begemann |
| 6,227,679 | B1 | 5/2001 | Zhang et al. |
| 6,234,648 | B1 | 5/2001 | Borner et al. |

(Continued)

FOREIGN PATENT DOCUMENTS

| | | | |
|---|---|---|---|
| EP | 1058221 | A2 | 12/2000 |
| EP | 0890059 | B1 | 6/2004 |

(Continued)

*Primary Examiner* — Alan Cariaso

(74) *Attorney, Agent, or Firm* — Dennis J. Williamson; Moore & Van Allen PLLC

(57) ABSTRACT

A LED lamp includes an optically transmissive enclosure and a base connected to the enclosure. LEDs are mounted on a ribbon for emitting light when energized though an electrical path from the base. The mounting ribbon for the LEDs has a surface that is positioned adjacent an interior surface of the enclosure for transmitting heat from the plurality of LEDs to the enclosure.

18 Claims, 10 Drawing Sheets

(56) References Cited

U.S. PATENT DOCUMENTS

| | | | | |
|---|---|---|---|---|
| 6,250,774 | B1 | 6/2001 | Begemann et al. | |
| 6,276,822 | B1 | 8/2001 | Bedrosian et al. | |
| 6,350,041 | B1 | 2/2002 | Tarsa et al. | |
| 6,465,961 | B1 | 10/2002 | Cao | |
| 6,523,978 | B1 | 2/2003 | Huang | |
| 6,550,953 | B1 | 4/2003 | Takahashi et al. | |
| 6,580,228 | B1 * | 6/2003 | Chen | F21K 9/135 257/E25.02 |
| 6,634,770 | B2 | 10/2003 | Cao | |
| 6,659,632 | B2 | 12/2003 | Chen | |
| 6,709,132 | B2 | 3/2004 | Ishibashi | |
| 6,803,607 | B1 | 10/2004 | Chan et al. | |
| 6,848,819 | B1 | 2/2005 | Arndt et al. | |
| 6,864,513 | B2 | 3/2005 | Lin et al. | |
| 6,948,829 | B2 | 9/2005 | Verdes et al. | |
| 6,982,518 | B2 | 1/2006 | Chou et al. | |
| 7,048,412 | B2 | 5/2006 | Martin et al. | |
| 7,080,924 | B2 | 7/2006 | Tseng et al. | |
| 7,086,756 | B2 | 8/2006 | Maxik | |
| 7,086,767 | B2 | 8/2006 | Sidwell et al. | |
| 7,144,135 | B2 | 12/2006 | Martin et al. | |
| 7,165,866 | B2 | 1/2007 | Li | |
| 7,172,314 | B2 | 2/2007 | Currie et al. | |
| 7,354,174 | B1 | 4/2008 | Yan | |
| 7,396,142 | B2 | 7/2008 | Laizure, Jr. et al. | |
| 7,600,882 | B1 | 10/2009 | Morejon et al. | |
| 7,726,836 | B2 | 6/2010 | Chen | |
| 7,824,065 | B2 | 11/2010 | Maxik | |
| 8,021,025 | B2 | 9/2011 | Lee | |
| 8,253,316 | B2 | 8/2012 | Sun et al. | |
| 8,272,762 | B2 | 9/2012 | Maxik et al. | |
| 8,274,241 | B2 | 9/2012 | Guest et al. | |
| 8,277,082 | B2 | 10/2012 | Dassanayake et al. | |
| 8,282,250 | B1 | 10/2012 | Dassanayake et al. | |
| 8,292,468 | B2 | 10/2012 | Narendran et al. | |
| 8,322,896 | B2 | 12/2012 | Falicoff et al. | |
| 8,371,722 | B2 | 2/2013 | Carroll | |
| 8,400,051 | B2 | 3/2013 | Hakata et al. | |
| 8,415,865 | B2 | 4/2013 | Liang et al. | |
| 8,421,320 | B2 | 4/2013 | Chuang | |
| 8,421,321 | B2 | 4/2013 | Chuang | |
| 8,421,322 | B2 | 4/2013 | Carroll et al. | |
| 8,421,329 | B2 | 4/2013 | Liang et al. | |
| 8,449,154 | B2 | 5/2013 | Uemoto et al. | |
| 8,502,468 | B2 | 8/2013 | Li et al. | |
| 8,562,161 | B2 | 10/2013 | Tong et al. | |
| 8,563,339 | B2 | 10/2013 | Tarsa et al. | |
| 8,641,237 | B2 | 2/2014 | Chuang | |
| 8,653,723 | B2 | 2/2014 | Cao et al. | |
| 8,696,168 | B2 | 4/2014 | Li et al. | |
| 8,702,279 | B2 * | 4/2014 | Oki | F21K 9/135 313/46 |
| 8,740,415 | B2 | 6/2014 | Wheelock | |
| 8,750,671 | B1 | 6/2014 | Kelly et al. | |
| 8,752,984 | B2 | 6/2014 | Lenk et al. | |
| 8,760,042 | B2 | 6/2014 | Sakai et al. | |
| 9,010,964 | B2 * | 4/2015 | Wang | F21V 3/0436 362/240 |
| 2004/0201990 | A1 | 10/2004 | Meyer | |
| 2005/0174769 | A1 * | 8/2005 | Yong | F21K 9/135 362/235 |
| 2008/0173884 | A1 | 7/2008 | Chitnis et al. | |
| 2008/0179611 | A1 | 7/2008 | Chitnis et al. | |
| 2009/0184618 | A1 | 7/2009 | Hakata et al. | |
| 2010/0008086 | A1 * | 1/2010 | Broitzman | F21V 3/04 362/231 |
| 2012/0040585 | A1 | 2/2012 | Huang | |

FOREIGN PATENT DOCUMENTS

| | | | |
|---|---|---|---|
| GB | 2345954 | A | 7/2000 |
| JP | H09265807 | A | 10/1997 |
| JP | 2000173304 | A | 6/2000 |
| JP | 2001118403 | A | 4/2001 |
| WO | 0124583 | A1 | 4/2001 |
| WO | 0160119 | A2 | 8/2001 |
| WO | 2012011279 | A1 | 1/2012 |
| WO | 2012031533 | A1 | 3/2012 |

* cited by examiner

LED LUMINAIRE WITH IMPROVED THERMAL MANAGEMENT AND NOVEL LED INTERCONNECTING ARCHITECTURE

This application claims benefit of priority under 35 U.S.C. §119(e) to the filing date of U.S. Provisional Application No. 61/802,079, as filed on Mar. 15, 2013, which is incorporated herein by reference in its entirety.

BACKGROUND OF THE INVENTION

1. Field of the Invention

This invention relates to solid state lamps and bulbs and in particular to light emitting diode (LED) based lamps and bulbs capable of providing omnidirectional emission patterns similar to those of filament based light sources.

2. Description of the Related Art

Light emitting diodes (LED or LEDs) are solid state devices that convert electric energy to light, and generally comprise one or more active layers of semiconductor material sandwiched between oppositely doped layers. When a bias is applied across the doped layers, holes and electrons are injected into the active layer where they recombine to generate light. Light is emitted from the active layer and from all surfaces of the LED.

In order to use an LED chip in a circuit or other like arrangement, it is known to enclose an LED chip in a package to provide environmental and/or mechanical protection, color selection, light focusing and the like. An LED package may also include electrical leads, contacts or traces for electrically connecting the LED package to an external circuit. In one embodiment of an LED package, a single LED chip is mounted on a reflective cup by means of a solder bond or conductive epoxy. One or more wire bonds connect the ohmic contacts of the LED chip to leads, which may be attached to or integral with the reflective cup. The reflective cup may be filled with an encapsulant material which may contain a wavelength conversion material such as a phosphor. Light emitted by the LED at a first wavelength may be absorbed by the phosphor, which may responsively emit light at a second wavelength. The entire assembly may be encapsulated in a clear protective resin, which may be molded in the shape of a lens to collimate the light emitted from the LED chip. While the reflective cup may direct light in an upward direction, optical losses may occur when the light is reflected (i.e. some light may be absorbed by the reflector cup due to the less than 100% reflectivity of practical reflector surfaces). In addition, heat retention may be an issue for a package, since it may be difficult to extract heat through the leads.

A conventional LED package may be more suited for high power operations which may generate more heat. In the LED package, one or more LED chips are mounted onto a carrier such as a printed circuit board (PCB) carrier, substrate or submount. A metal reflector may be mounted on the submount that surrounds the LED chip(s) and reflects light emitted by the LED chips away from the package. The reflector may also provide mechanical protection to the LED chips. One or more wirebond connections are made between ohmic contacts on the LED chips and electrical traces on the submount. The mounted LED chips are then covered with an encapsulant, which may provide environmental and mechanical protection to the chips while also acting as a lens. The metal reflector is typically attached to the carrier by means of a solder or epoxy bond.

LED chips, such as those found in the LED package can be coated by conversion material comprising one or more phosphors, with the phosphors absorbing at least some of the LED light. The LED chip can emit a different wavelength of light such that it emits a combination of light from the LED and the phosphor. The LED chip(s) can be coated with a phosphor using many different methods, with one suitable method being described in U.S. patent application Ser. Nos. 11/656,759 and 11/899,790, both to Chitnis et al. and both entitled "Wafer Level Phosphor Coating Method and Devices Fabricated Utilizing Method". Alternatively, the LEDs can be coated using other methods such as electrophoretic deposition (EPD), with a suitable EPD method described in U.S. Pat. No. 8,563,339 issued Oct. 22, 2013 to Tarsa et al. entitled "Close Loop Electrophoretic Deposition of Semiconductor Devices".

In these embodiments the phosphor material is on or in close proximity to the LED epitaxial layers and in some instances comprises a conformal coat over the LED. In these arrangements, the phosphor material can be subjected to direct chip heating which can cause the phosphor material to heat. This elevated operating temperature can cause degradation of the phosphor material over time. It can also cause a reduction in phosphor conversion efficiency and a shift in conversion color.

Lamps have been developed utilizing solid state light sources, such as LEDs, with a conversion material that is separated from or remote to the LEDs. Such arrangements are disclosed in U.S. Pat. No. 6,350,041 issued Feb. 26, 2002 to Tarsa et al., entitled "High Output Radial Dispersing Lamp Using a Solid State Light Source." The lamps described in this patent can comprise a solid state light source that transmits light through a separator to a disperser having a phosphor. The disperser can disperse the light in a desired pattern and/or change its color by converting at least some of the light through a phosphor. In some embodiments, the separator spaces the light source a sufficient distance from the disperser such that heat from the light source will not transfer to the disperser when the light source is carrying elevated currents necessary for room illumination.

LED based bulbs have been developed that utilize large numbers of low brightness LEDs (e.g. 5 mm LEDs) mounted to a three-dimensional surface to achieve wide-angle illumination. Some of these designs, however, do not provide optimized omnidirectional emission that fall within standard uniformity requirements. Some of these bulbs also contain a large number of interconnected LEDs making them prohibitively complex, expensive and unreliable. This makes these LED bulbs generally impractical for most illumination purposes.

Other LED bulbs have also been developed that use a mesa-type design for the light source with one LED on the top surface and seven more on the sidewalls of the mesa (see GeoBulb®-II provided by C. Crane). This arrangement, however, does not provide omnidirectional emission patterns, but instead provides a pattern that is substantially forward biased. The mesa for this bulb also comprises a hollow shell, which can limit its ability to thermally dissipate heat from the emitters. This can limit the drive current that can be applied to the LEDs. This design is also relatively complex, using several LEDs, and is not compatible with large volume manufacturing of low-cost LED bulbs.

SUMMARY OF THE INVENTION

In some embodiments a LED lamp comprises an enclosure that is at least partially optically transmissive and comprises an interior surface and defines an interior. A base is connected to the enclosure. A plurality of LEDs are mounted on a thermally conductive ribbon for emitting light when energized though an electrical path from the base. The ribbon has a surface that is disposed adjacent to the interior surface of the enclosure for transmitting heat from the plurality of LEDs to the enclosure.

The base may comprise an Edison base. The plurality of LEDs may be disposed near the interior surface of the enclosure and are positioned to direct light primarily inwardly toward a center of the enclosure. The plurality of LEDs may be disposed about the periphery of the enclosure. A plurality of ribbons may each support a plurality of LEDs. Each of the plurality of ribbons may be in the electrical path. The plurality of LEDs may be mounted on a mounting surface of the ribbon, and the surface of the ribbon and the mounting surface may be part of the same physical component. The plurality of LEDs may be mounted directly to the ribbon. The outer dimensions of the lamp may fall within the ANSI standards for an A series bulb. Electrical conductors for providing current to the plurality of LEDs may be formed on the ribbon. The ribbon may comprise one of aluminum board, flexible PCB, lead frame, PCB and MCPCB. The ribbon may be formed into a three-dimensional shape that comprises portions that are shaped to conform to the shape of the interior surface of the enclosure. The ribbon may be bent along score lines. The plurality of LEDs may be oriented at different angles relative to a longitudinal axis of the lamp. A power supply may be located in the base. A tower may extend into the enclosure for supporting a second plurality of LEDs. The tower may form part of a heat sink for dissipating heat from the second plurality of LEDs. The heat sink may extend at least partially outside of the lamp. The heat sink may be thermally coupled to the plurality of LEDs for dissipating heat from the plurality of LEDs.

In some embodiments a LED lamp comprises an enclosure that is at least partially optically transmissive and comprises an interior surface having a shape. A base is connected to the enclosure. A plurality of LEDs are mounted on a first surface of a thermally conductive ribbon for emitting light when energized though an electrical path from the base. The ribbon has a second surface that is disposed adjacent to the interior surface of the enclosure for transmitting heat from the plurality of LEDs to the enclosure where the second surface conforms to the shape of the interior surface over the length of the ribbon.

DETAILED DESCRIPTION OF EMBODIMENTS OF THE INVENTION

Figure 1:
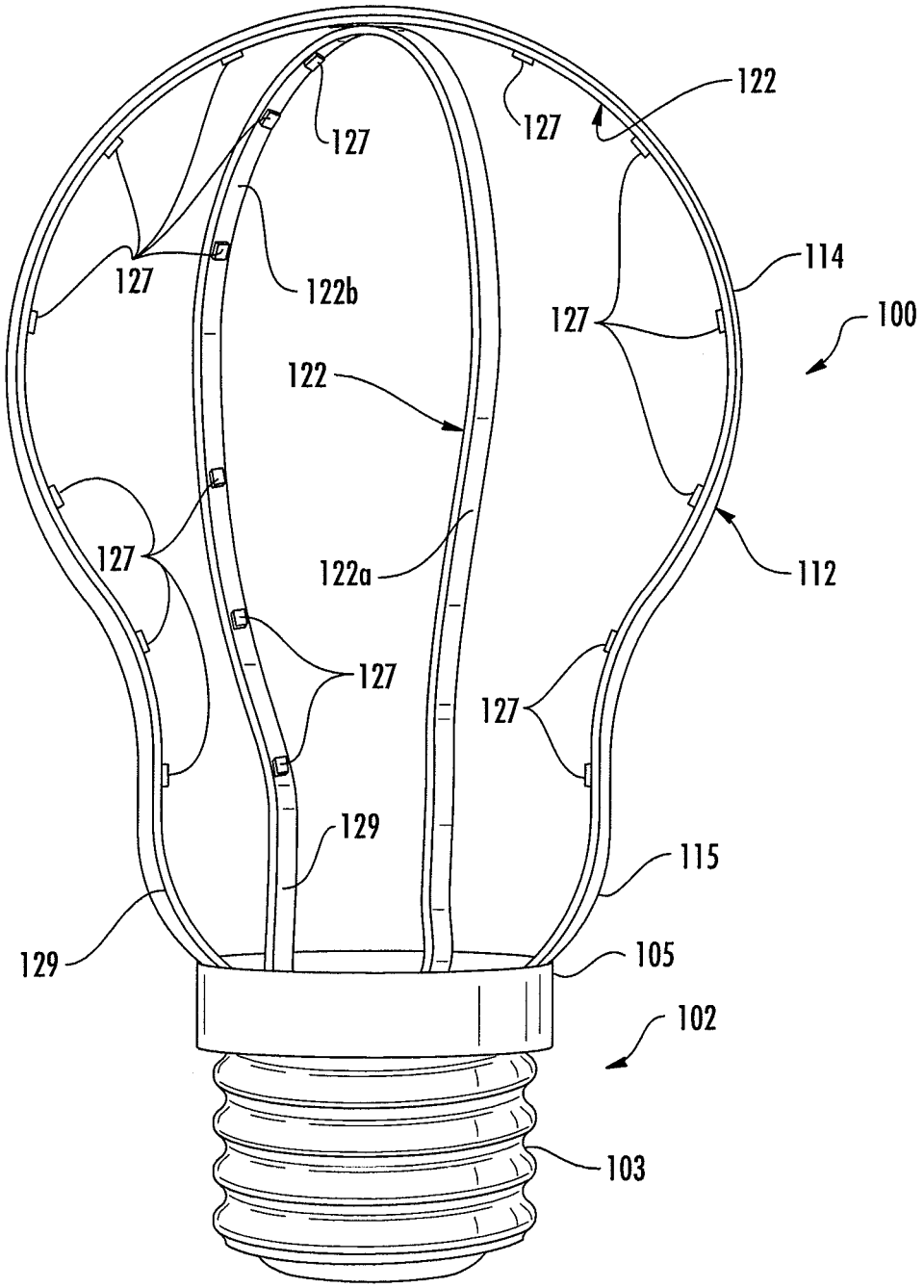
FIG. 1 is a perspective view of an embodiment of a lamp of the invention.

Embodiments of the present invention now will be described more fully hereinafter with reference to the accompanying drawings, in which embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element, without departing from the scope of the present invention. As used herein, the term "and/or" includes any and all combinations of one or more of the associated listed items.

It will be understood that when an element such as a layer, region or substrate is referred to as being "on" or extending "onto" another element, it can be directly on or extend directly onto the other element or intervening elements may also be present. In contrast, when an element is referred to as being "directly on" or extending "directly onto" another element, there are no intervening elements present. It will also be understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements present.

Relative terms such as "below" or "above" or "upper" or "lower" or "horizontal" or "vertical" or "top" or "bottom" may be used herein to describe a relationship of one element, layer or region to another element, layer or region as illustrated in the figures. It will be understood that these terms are intended to encompass different orientations of the device in addition to the orientation depicted in the figures.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" "comprising," "includes" and/or "including" when used herein, specify the presence of stated features, integers, steps, operations, elements, and/or components, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art to which this invention belongs. It will be further understood that terms used herein should be interpreted as having a meaning that is consistent with their meaning in the context of this specification and the relevant art and will not be interpreted in an idealized or overly formal sense unless expressly so defined herein.

Unless otherwise expressly stated, comparative, quantitative terms such as "less" and "greater", are intended to encompass the concept of equality. As an example, "less" can mean not only "less" in the strictest mathematical sense, but also, "less than or equal to."

The terms "LED" and "LED device" as used herein may refer to any solid-state light emitter. The terms "solid state light emitter" or "solid state emitter" may include a light emitting diode, laser diode, organic light emitting diode, and/or other semiconductor device which includes one or more semiconductor layers, which may include silicon, silicon carbide, gallium nitride and/or other semiconductor materials, a substrate which may include sapphire, silicon, silicon carbide and/or other microelectronic substrates, and one or more contact layers which may include metal and/or other conductive materials. A solid-state lighting device produces light (ultraviolet, visible, or infrared) by exciting electrons across the band gap between a conduction band and a valence band of a semiconductor active (light-emitting) layer, with the electron transition generating light at a wavelength that depends on the band gap. Thus, the color (wavelength) of the light emitted by a solid-state emitter depends on the materials of the active layers thereof. In various embodiments, solid-state light emitters may have peak wavelengths in the visible range and/or be used in combination with lumiphoric materials having peak wavelengths in the visible range. Multiple solid state light emitters and/or multiple lumiphoric materials (i.e., in combination with at least one solid state light emitter) may be used in a single device, such as to produce light perceived as white or near white in character. In certain embodiments, the aggregated output of multiple solid-state light emitters and/or lumiphoric materials may generate warm white light output.

Solid state light emitters may be used individually or in combination with one or more lumiphoric materials (e.g., phosphors, scintillators, lumiphoric inks) and/or optical elements to generate light at a peak wavelength, or of at least one desired perceived color (including combinations of colors that may be perceived as white). Inclusion of lumiphoric (also called 'luminescent') materials in lighting devices as described herein may be accomplished by direct coating on solid state light emitter, adding such materials to encapsulants, adding such materials to lenses, by embedding or dispersing such materials within lumiphor support elements, and/or coating such materials on lumiphor support elements. Other materials, such as light scattering elements (e.g., particles) and/or index matching materials, may be associated with a lumiphor, a lumiphor binding medium, or a lumiphor support element that may be spatially segregated from a solid state emitter.

As used herein, the term "source" can be used to indicate a single light emitter or more than one light emitter functioning as a single source. For example, the term may be used to describe a single blue LED, or it may be used to describe a red LED and a green LED in proximity emitting as a single source. Thus, the term "source" should not be construed as a limitation indicating either a single-element or a multi-element configuration unless clearly stated otherwise.

The term "color" as used herein with reference to light is meant to describe light having a characteristic average wavelength; it is not meant to limit the light to a single wavelength. Thus, light of a particular color (e.g., green, red, blue, yellow, etc.) includes a range of wavelengths that are grouped around a particular average wavelength. Furthermore, the term "color" is meant to include wavelengths outside the visible spectrum, such as ultraviolet and infrared wavelengths, for example.

Embodiments of the present invention provide various embodiments of lamps, bulbs, troffers, and other fixtures that are efficient, reliable and cost effective and can be arranged to provide a desirable emission pattern. Some embodiments include LED strips or strings within a bulb which emit into the volume of the lamp. Other embodiments can also comprise solid state emitters arranged on a pedestal having thermal management features to control heat build-up in the emitters. These embodiments can also comprise shaped remote phosphors that can also have thermal management features to control conversion heat build-up in the remote phosphor. Embodiments can also have diffuser features to generate the desired emission pattern for the lamps and bulbs. Embodiments can include LEDs mounted on or near such a diffuser. Further, in some embodiments, an internal mounting surface, optical element, or diffuser can serve as a heat sink to help avoid overheating of lamp circuitry and other lamp components. Examples of possible surfaces include an internal surface of a light bulb, the backside of a heat sink in an indirect troffer fixture, and an internal metal backside of a troffer (e.g., one covered with a reflective white material), although many other surfaces are possible. Lamps and bulbs incorporating elements of the present invention are described, for example, in U.S. Pat. No. 8,562,161 issued Oct. 22, 2013 to Tong et al., entitled "LED Based Pedestal-Type Lighting Structure", which is incorporated herein by reference in its entirety.

In one embodiment of the present invention, LED chips or packages (referred to collectively herein as "LEDs") are mounted on a ribbon which is on or near the inside surface of an optical element such as a diffuser or optically transmissive enclosure. Some examples of LEDs that can be used in the present invention include the XTE and XBD LEDs manufactured by CREE, INC.®. Some examples of ribbon material include wire or flexible printed circuit board (PCB), for example, and in one embodiment can be shaped to match the contours of an inner surface of a bulb. The ribbon can provide an electrical connection to and between the LEDs. The LEDs can have a directional emission and can emit inward. This emission can help avoid hotspots and provide a more uniform lamp emission. The optical element surface, such as a glass bulb, can serve as a heat sink for the LED and/or the ribbons. Thus, in some embodiments the lamp does not need an external heat sink. This can improve cost efficiency and can improve aesthetics.

In an embodiment of the LED, circuitry components can be located in the base of the bulb, including drive circuitry and capacitors for example. Circuitry typically cannot operate reliably if too much heat from LED heat dissipation reaches the circuitry. In traditional lamps and/or bulbs (used interchangeably herein), an external heat sink is located near the base of the bulb, which can affect the circuitry. By dissipating heat through the ribbons and the diffuser (for example, the glass of a light bulb), embodiments of the present invention can avoid overheating of the circuitry, thus increasing reliability.

In order to achieve effective heat dissipation, embodiments of the present invention can have LEDs in acceptable thermal contact with an optical element such as an optically transmissive enclosure. In one embodiment, the LEDs and/or LED strings are physically mounted on the optical element or in physical or thermal contact with the optical element. In other embodiments they are within close proximity of the optical element. In one embodiment the LED strings are within 1 mm of the optical element; in another embodiment the LED strings are located within 0.3 mm of the optical element. These placements will help achieve an acceptable steady state operating temperature of the LEDs.

The ribbon of the LED strings can have multiple functionalities in embodiments of the present invention. First, the ribbon can electrically connect the LEDs to one another and to a power source. The ribbon can serve as a thermal path for the LEDs to spread heat along the ribbon to allow for low junction operating temperature of the LEDs. The ribbon can also be a mechanical support for the LEDs, preventing the LEDs from being displaced during use or handling. This can allow the LEDs to be located at predetermined positions in a fixture, such as at predetermined positions along the inside glass wall of a bulb or optically trasnmissive enclosure. The ribbon can also serve to electrically isolate the LEDs from the surface on which the LED string is mounted.

Embodiments of the present invention can be combined with conventional technology such as conventional glass bulbs. Further, some LEDs can be in thermal contact with the optical element while others can be in contact with an external heat sink (e.g., those described in U.S. Pat. No. 8,562,161). By incorporating elements of the present invention, the base of the bulb and/or the circuitry are kept cooler which can enable a higher lumen light bulb to be operated reliably. For example, a light bulb incorporating elements of the present invention can be a 40 W, 60 W, 75 W, or 100 W equivalent light bulb or other equivalent wattages.

In one embodiment, the ribbons on which LEDs are mounted are thermally conductive. The ribbon may comprise a highly reflective white surface such a thermally conductive paper, coating, paint etc. The reflective white surface may be formed on the back or outer surface of the ribbon and/or on the mounting face of the ribbon on which the LEDs are mounted. The reflective surface may be provided on any surface that is exposed to the light. Some embodiments include materials available from WhiteOptics, LLC. Such embodiments may be more aesthetically pleasing when the lamp is off.

In some embodiments incorporating elements of the present invention, the LED strings can be held against the optical element inner walls with a mechanical spring action. In such embodiments, the ribbon on which the LEDs are mounted can have spring properties. The LEDs can be supported in one or more places, such as the base of the optical element, on an external heat sink element, or the like. In some such embodiments the LED strings are held against an optical element by the spring action, while in other embodiments the spring action holds the LED strings close to the optical element. Some similar embodiments do not use a spring structure, but instead use a measured stiff material as the LED ribbon.

In some embodiments of the present invention the LED strings can be mounted to the optical element inner walls using well-known adhesives. In one method incorporating elements of the present invention, the LED strings have adhesive on the outer or backside of the ribbon. The strings are inserted into the optical element followed by an expandable bladder. The bladder is then filled with air or gas which can uniformly press the ribbon surface with adhesive onto the optical element walls. If necessary, bladder pressure can be maintained while the adhesive is cured.

Embodiments of the present invention comprise an enclosure that is at least partially optically transmissive enclosure through which light is emitted from the lamp. The optically transmissive enclosure may comprise a transparent or translucent enclosure such as a dome or bulb which can be made of material including glass, plastic, polymer, a combination thereof, or many other materials. Other embodiments include a transparent, translucent, reflective, or partially reflective mount surface (e.g., a mount surface within a troffer). A material with good thermal conductivity is preferred in order to help effectively spread and dissipate heat from the LED strings. The optically transmissive enclosure may be frosted, which in some situations improves aesthetics by visually hiding the LED strings mounted on the inside surface of the optically transmissive enclosure. Preferred materials do not cause optical losses or alter the desired optical beam pattern when LED strings are mounted thereon. Many different optical element sizes and profiles are possible. One embodiment incorporating elements of the present invention is embodied in the form factor of an A19 or larger bulb.

Figure 2:
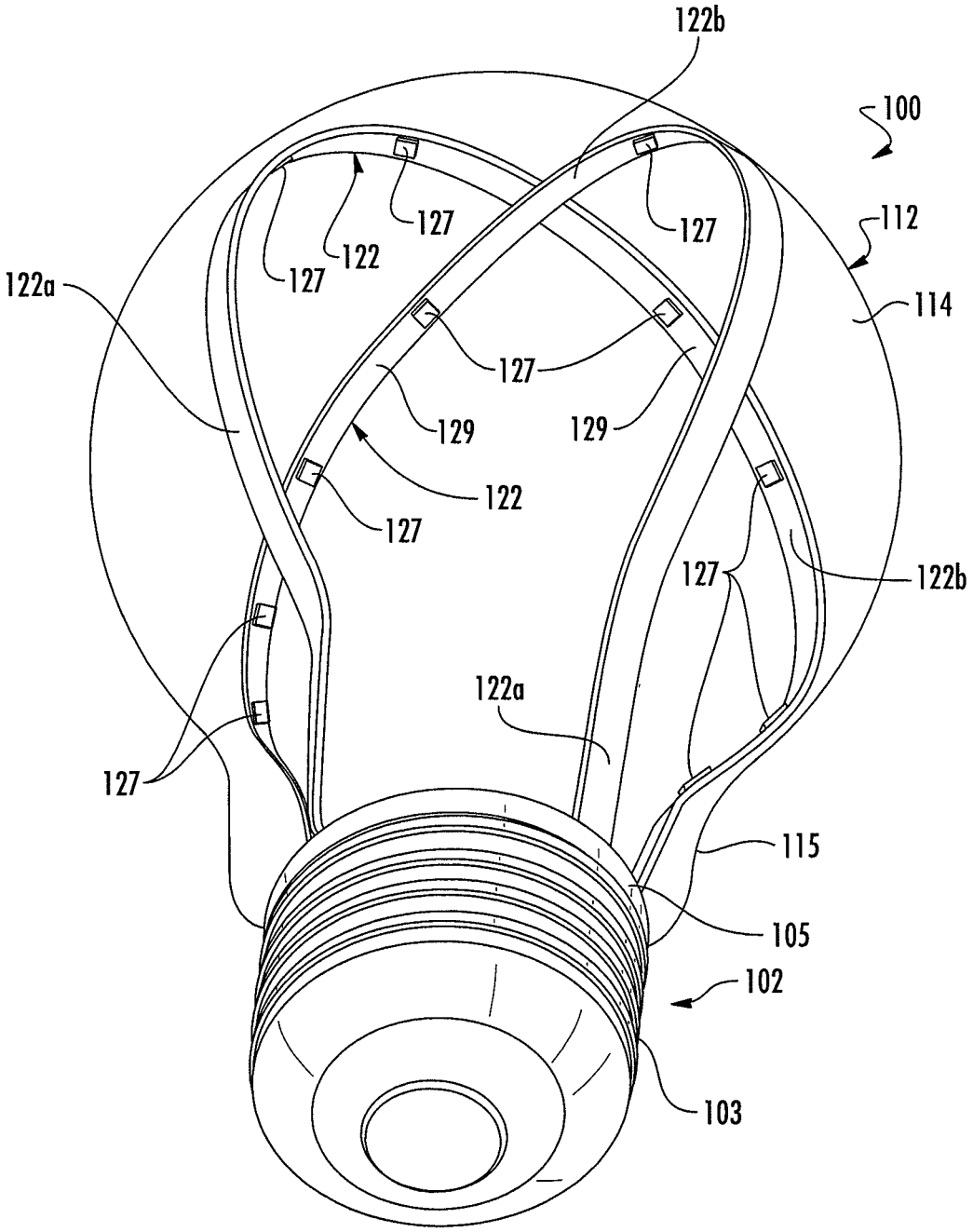
FIG. 2 is another perspective view of the lamp of FIG. 1.
Figure 3:
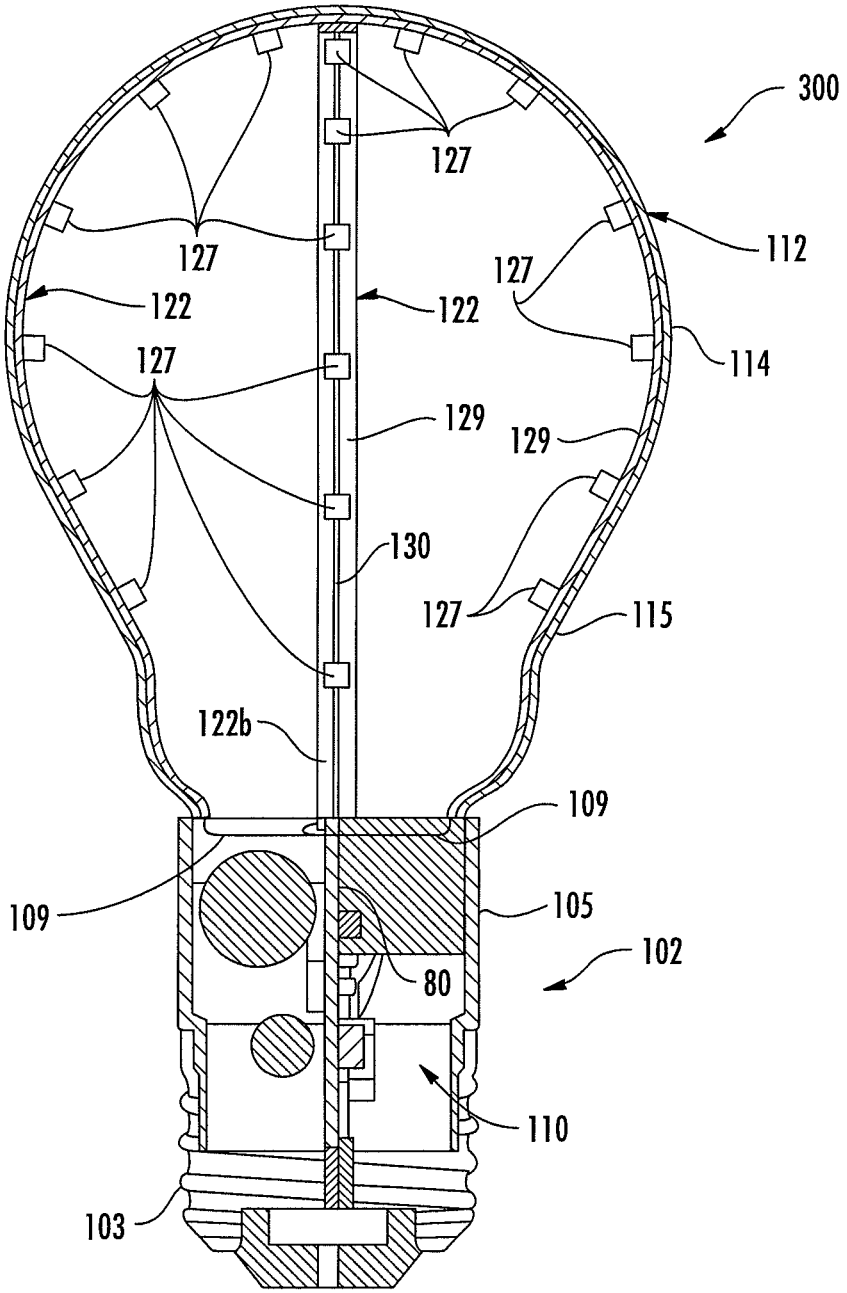
FIG. 3 is a section view of an embodiment of a lamp of the invention.

FIGS. 1-3 are views of an embodiment of a LED lamp incorporating elements of the present invention. Lamp 100 comprises a base 102 connected to an optical element such as the optically transmissive enclosure 112 or "bulb". Lamp 100 may be used as a replacement for an A-series lamp with an Edison base 102; more particularly, lamp 100 may be designed to serve as a solid-state replacement for an A19 or other A series incandescent bulb. In an A series style lamp the enclosure may be entirely optically treansmissive. The Edison base 102 as shown and described herein may be implemented through the use of an Edison connector 103 and a housing 105. LEDs 127 are mounted on ribbons 129 and are operable to emit light when energized through an electrical connection through the Edison base 102. In some embodiments, electrical circuitry may be provided on the ribbons for delivering electric current to the LEDs 127. While a lamp having the size and form factor of a standard-sized household incandescent bulb is shown, the lamp may have other the sizes and form factors.

Enclosure 112 is, in some embodiments, made of glass, quartz, borosilicate, silicate, polycarbonate, other plastic or other suitable material. In one embodiment the enclosure 112 is made of a thermally conductive material. The enclosure 112 may be of similar shape to that commonly used in household incandescent bulbs. It should also be noted that the enclosure 112 or a portion of the enclosure could be coated or impregnated with phosphor. The enclosure 112 may have a traditional bulb shape having a globe shaped main body 114 that tapers to a narrower neck 115. The enclosure 112 may be transparent or translucent such that the light emitted into the interior of the enclosure, passes through the enclosure and is emitted from the enclosure. The enclosure may be formed of a light diffusing material or a light diffusing material may be added to a transparent enclosure. In the illustrated embodiments the enclosure 112 is shown as clear in order to show the internal structures of the lamp; however, the enclosure 112 may be provided with a diffusive layer such as a coated, frosted or etched surface where the internal structure of the lamp is not visible or is only partially visible through the diffusive layer.

A lamp base 102 such as an Edison base functions as the electrical connector to connect the lamp 100 to an electrical socket or other connector. Depending on the embodiment, other base configurations are possible to make the electrical connection such as other standard bases or non-standard bases. Base 102 may include the electronics 110 for powering the lamp and may include a power supply and/or driver and form all or a portion of the electrical path between the mains and the LEDs 127. Base 102 may also include only part of the power supply circuitry while some components may reside on the ribbon 129 or elsewhere in the enclosure 112. Electrical conductors 109 run between the LEDs 127 and the electronics 110 in the lamp base 102 to carry both sides of the supply to provide critical current to the LEDs 127. The base 102 comprises an electrically conductive Edison screw 103 for connecting to an Edison socket and may comprise a housing portion 105 connected to the Edison screw. The Edison screw 103 may be connected to the housing portion 105 by adhesive, mechanical connector, welding, separate fasteners or the like. The housing portion 105 may comprise an electrically insulating material such as plastic. Further, the material of the housing portion 105 may comprise a thermally conductive material such that the housing portion 105 may form part of the heat sink structure for dissipating heat from the lamp 100. The housing portion 105 and the Edison screw 103 define an internal cavity for receiving the electronics 110 of the lamp including the power supply and/or drivers or a portion of the electronics for the lamp. The lamp electronics 110 are electrically coupled to the Edison screw 103 such that the electrical connection may be made from the Edison screw 103 to the lamp electronics 110. The base 102 may be potted to physically and electrically isolate and protect the lamp electronics 110. While an Edison base is shown the base may comprise any suitable connector for providing current to the lamp including a bayonet type connector or other connector.

The lamp 100 comprises a solid-state lamp comprising a plurality of LEDs 127. Multiple LEDs 127 can be used together. The LEDs 127 are mounted on ribbon 129 where each ribbon 129 typically supports a plurality of LEDs 127. The ribbon 129 comprises an efficient thermal conducting material. In various embodiments the ribbon 129 may comprise an aluminum LED board, a lead frame structure, printed circuit board (PCB), flexible PCB, metal core printed circuit board (MCPCB) or any suitable thermally conductive substrate for mounting the LEDs 127. In some embodiments the ribbon 129 may comprise a flexible member. The ribbons may have a relatively narrow width where the width is wide enough to mount the LEDs but may be made as narrow as possible to block as little light as possible. In addition to being thermally conductive and providing physical support for the LEDs the ribbon may also provide the electrical path between the electronics 110 in the base and the LEDs. In some embodiments, conductive traces or wire traces 130 may be formed on the ribbons 129 that form part of the electrical path between the lamp electronics 110 in the base 102 and the LEDs 127. In other embodiments, separate electric conductors may be provided to form the electrical path between the lamp electronics and the LEDs. With the embodiment of FIG. 1, as with many other embodiments of the invention, the term "electrical path" can be used to refer to the entire electrical path to the LEDs 127, including an intervening power supply disposed between the electrical connection that would otherwise provide power directly to the LEDs and the LED array, or it may be used to refer to the connection between the mains and all the electronics in the lamp, including the power supply. The term may also be used to refer to the connection between the power supply and the LED array. Electrical conductors run between the LEDs 127 and the lamp base 102 to carry both sides of the supply to provide critical current to the LEDs 127 as will be described.

The ribbons 129 provide the physical support for the LEDs 127 and properly position the LEDs in the enclosure 112. The ribbons 129 are arranged such that the LEDs 127 are disposed about the periphery of the enclosure 112 at or near the surface of the enclosure and are positioned to direct light primarily inwardly toward the center of the enclosure. The ribbons 129 may be in electrical connection with the electronics 110 in the base 102 such that an electrical connection is established between the base and the LEDs 127 mounted on the ribbons 129. Each ribbon 129 may comprise a single one-piece component or each ribbon may comprise a plurality of separate components such as may be found in MCPCB. The ribbons 129 may be considered a mount for the LEDs 127. The ribbons 129 and LEDs 127 may be evenly spaced about the periphery of the enclosure 112 such that the light projected from each LED string projects over an equal area of the enclosure 112.

As shown in FIGS. 1-3, in some embodiments, the LED lamp 100 may comprise two LED strings 122, which themselves comprise an LED ribbon 129 and one or more LEDs 127. The outer surface 122*a* and inner surface 122*b* can be made of a reflective material and/or be covered in a white reflective material, as described above. The lamp 100 comprises an optically transmissive enclosure 112, which can dissipate heat generated by the LEDs. In the illustrated embodiment each LED string 122 includes 12 LEDs 127 for a total of 24 LEDs, although more or less LEDs per string 122 are possible. The width of the LED ribbon 129 in this embodiment is 3 mm, although thinner or wider LED ribbons are possible.

Figure 4:
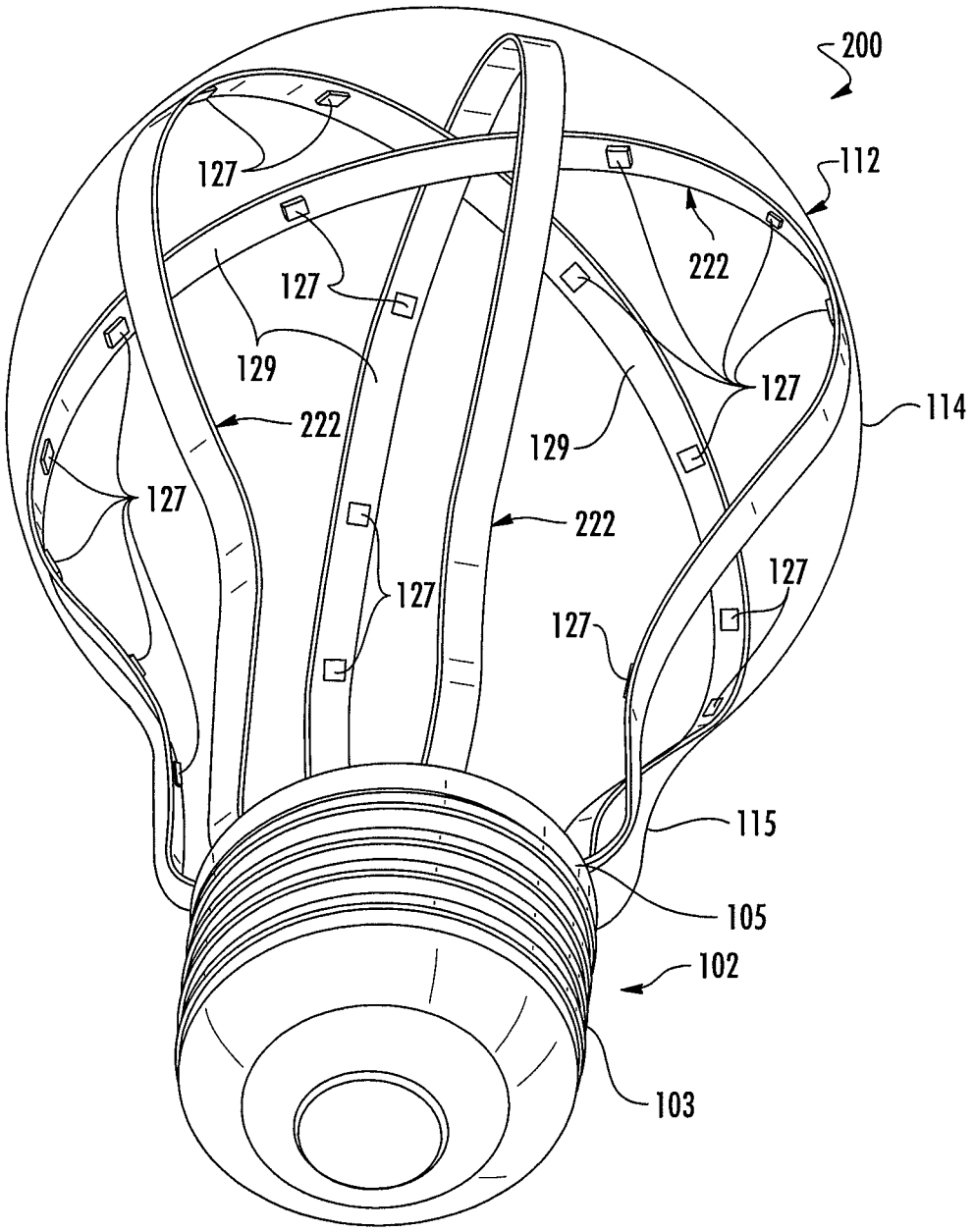
FIG. 4 is a perspective view of another embodiment of a lamp of the invention.

FIG. 4 shows a perspective view of a lamp 200 similar to the lamp 100, but comprising three LED strings 222 with 12 LEDs 127 per string for a total LED count of 36. In the embodiments of FIGS. 1-4, the LED strings 102 and 202 are mounted symmetrically, and cross at the top apex of the enclosure 112, respectively. However, the strings 102 and 202 do not have to be mounted symmetrically relative to the enclosure 112.

Figure 5:
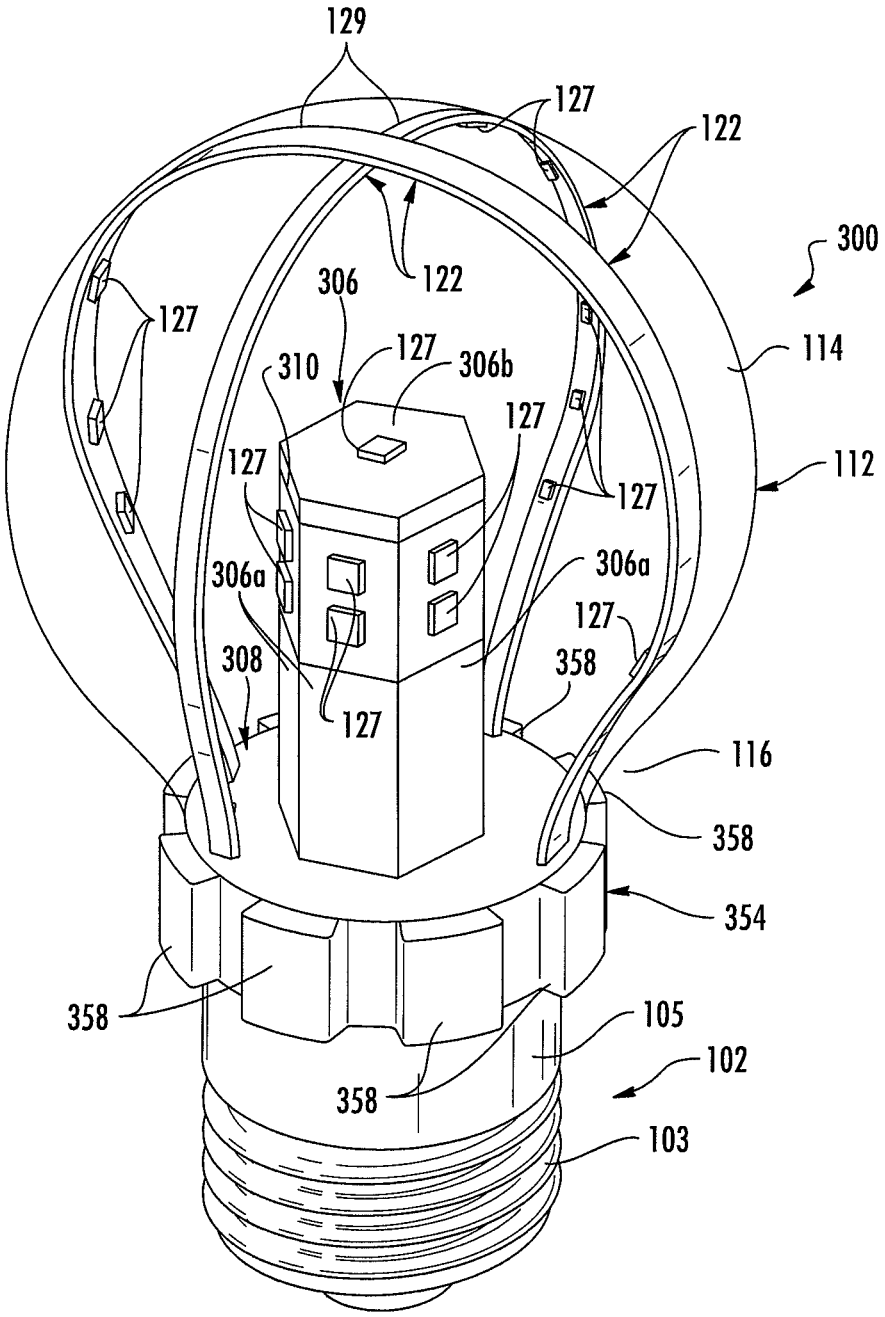
FIG. 5 is a perspective view of yet another embodiment of a lamp of the invention.
Figure 7:
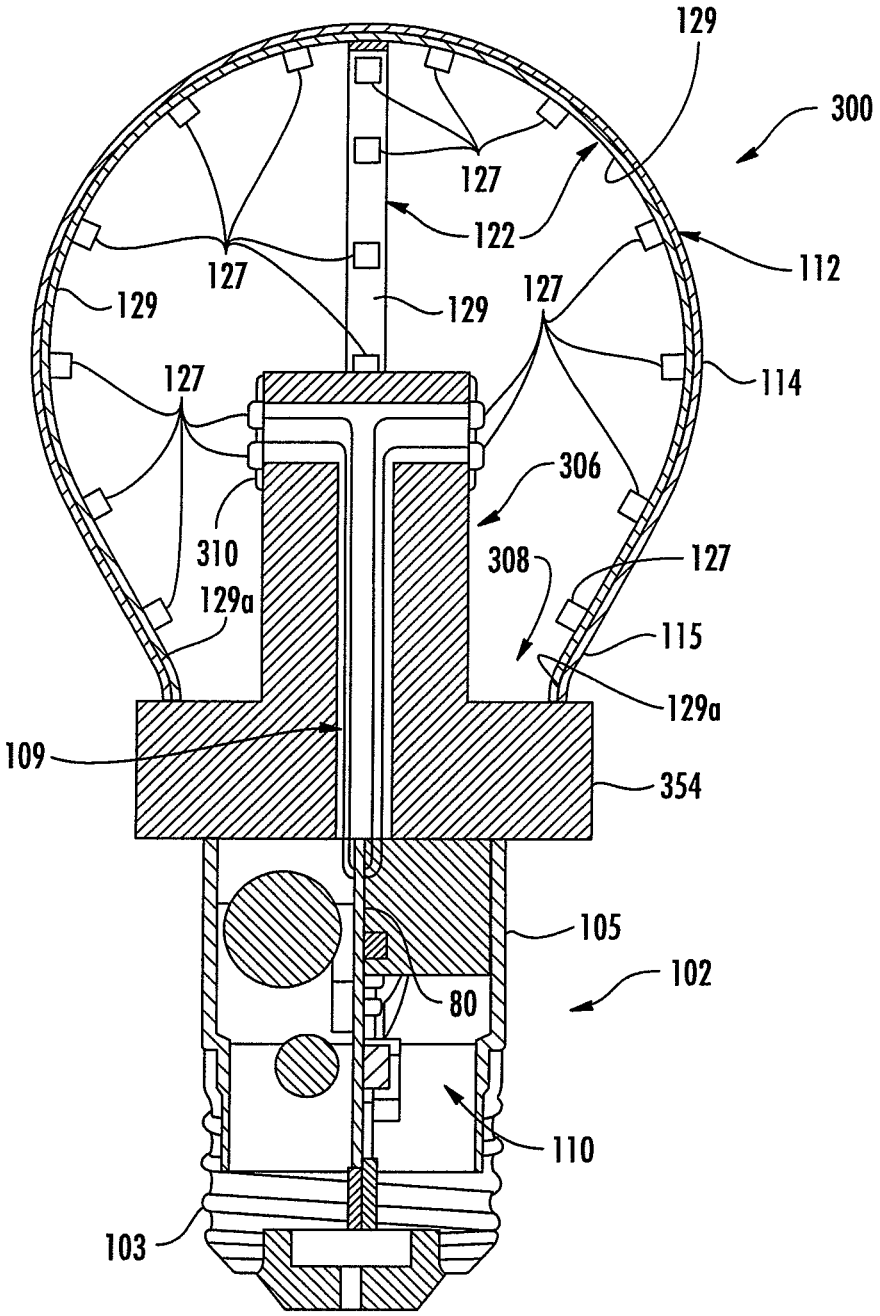
FIG. 7 is a section view of an embodiment of a lamp of the invention.

FIGS. 5 and 7 show a lamp 300 similar to the lamp 100, but also incorporating an LED post 306 and a heat sink 308. The post 306 can have thermal dissipation qualities. In the embodiment shown, the LED post 306 supports 12 LEDs where two LEDs are mounted on each of six sides 306*a* of post 306. The LEDs 127 may be mounted on a substrate 310 or other support that is mounted on the tower or post 306. The substrate may comprise an aluminum LED board, a lead frame structure, printed circuit board (PCB), flexible PCB, metal core printed circuit board (MCPCB), combinations of such elements or any suitable thermally conductive substrate for mounting the LEDs 127. In addition to being thermally conductive and providing physical support for the LEDs the substrate may also provide the electrical path between the electronics 110 in the base 102 and the LEDs 127. In some embodiments, conductive traces or wire traces may be formed on the substrate that form part of the electrical path between the lamp electronics 110 in the base 102 and the LEDs 127. Other embodiments can comprise more or fewer LEDs and more or fewer sides, and can also comprise one or more LEDs 127 on a top surface 306*b* of the post 306. Some posts which can be incorporated in embodiments incorporating elements of the present invention are described, for example, in U.S. Pat. No. 8,562,161, which is incorporated by reference herein in its entirety. The heat sink 308 may comprise a heat conducting portion formed as the tower or post 306 and a heat dissipating portion 354. In one embodiment the heat sink 308 is made as a one-piece member of a thermally conductive material such as aluminum. The heat sink 308 may also be made of multiple components secured together to form the heat sink. Moreover, the heat sink 308 may be made of any thermally conductive material or combinations of thermally conductive materials. The LEDs may be positioned at the approximate center of enclosure 112. As used herein the terms "center of the enclosure" and "optical center of the enclosure" refers to the vertical position of the LEDs in the enclosure as being aligned with the approximate largest diameter area of the globe shaped main body 114. "Vertical" as used herein means along the longitudinal axis of the bulb where the longitudinal axis extends from the base to the free end of the bulb. In one embodiment, the LED array 128 is arranged in the approximate location that the visible glowing filament is disposed in a standard incandescent bulb. The terms "center of the enclosure" and "optical center of the enclosure" do not necessarily mean the exact center of the enclosure and are used to signify that the LEDs are located along the longitudinal axis of the lamp at a position between the ends of the enclosure near a central portion of the enclosure.

The heat conducting portion 306 is formed as a tower or post that is dimensioned and configured to make good thermal contact with the LEDs 127 mounted on the tower or post 306 such that heat generated by the LEDs may be efficiently transferred to the heat sink 308. While the heat conducting portion 306 is shown as being generally cylindrical with flat faces 306*a* these components may have any configuration provided good thermal conductivity is created between the LEDs 127 and the heat conducting portion. While in some embodiments the heat conducting portion is formed as the tower 306 that supports the LEDs 127, the tower 306 may be made of a thermally non-conductive material such as plastic and the heat conducting portion may be a separate component, such as aluminum rods, that thermally couple the LEDs to the heat dissipating portion 354.

The heat dissipating portion 354 is thermally coupled to the heat conducting portion 306 such that heat conducted away from the LEDs 127 by the heat conducting portion 306 may be efficiently dissipated from the lamp 100 by the heat dissipating portion 354. In one embodiment the heat conducting portion 306 and heat dissipating portion 354 are formed as one-piece. The heat dissipating portion 354 extends to the exterior of the lamp 100 such that heat may be dissipated from the lamp to the ambient environment. In one embodiment, the heat dissipating portion 354 comprises plurality fins 358 that extend outwardly to increase the surface area of the heat dissipating portion 354. The heat dissipating portion 354 and heat dissipating members 358 may have any suitable shape and configuration. Different embodiments of the LED assembly and heat sink tower are possible. In various embodiments, the LED assembly may be relatively shorter, longer, wider or thinner than that shown in the illustrated embodiment. The ribbons may be thermally coupled to the heat dissipating portion 354 such as by physically connecting the ribbons to the heat conducting portion 354. In other embodiments, intervening elements may be provided between the ribbons 129 and the heat dissipating portion 354 to thermally couple these elements to one another.

Figure 6:
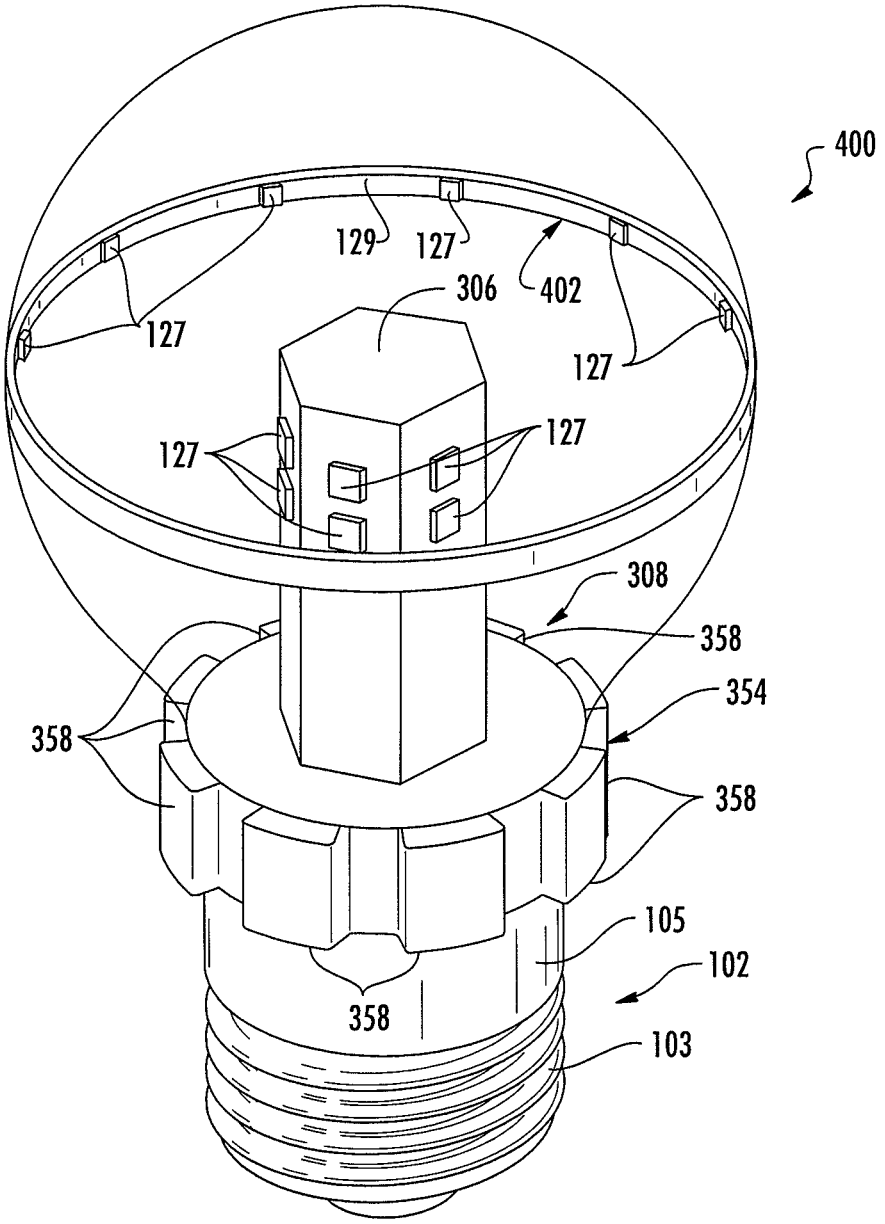
FIG. 6 is a perspective view of still another embodiment of a lamp of the invention.

FIG. 6 shows a perspective view of a lamp 400 including a single LED string 402. The LED string 402 includes 12 LEDs 127 and is arranged to extend along the equator of the enclosure 112 (i.e., along the approximately largest diameter of the bulb). The lamp 400 also includes the post or tower 306 and heat sink 308 as previously described with respect to FIGS. 5 and 7.

Figure 10:
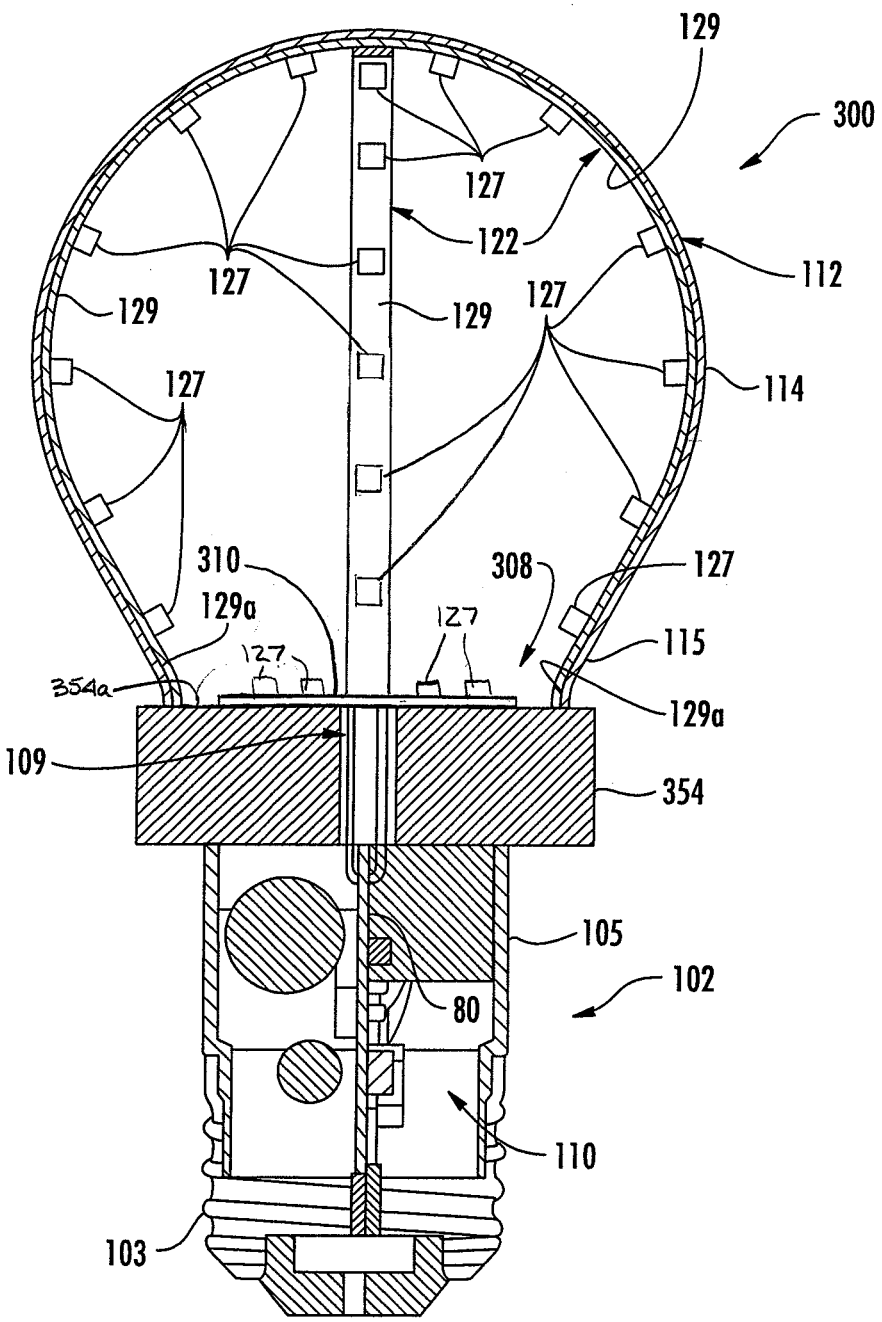
FIG. 10 is a section view of another embodiment of the lamp of the invention.

FIG. 10 shows an alternate embodiment of the lamp where heat dissipating portion 354 of heat sink 308 is used but the tower 306 is eliminated. The LEDs 127 may be mounted on the transverse surface 354*a* of the heat dissipating portion 354. The LEDs 127 may be mounted on a substrate 310 or other support that is mounted on the heat sink 308. The LEDs 127 on the heat sink 308 are mounted adjacent the base near the opening into the enclosure 112 and may direct light primarily toward the distal end of the lamp and secondarily laterally toward the sides of the lamp.

Figure 9:
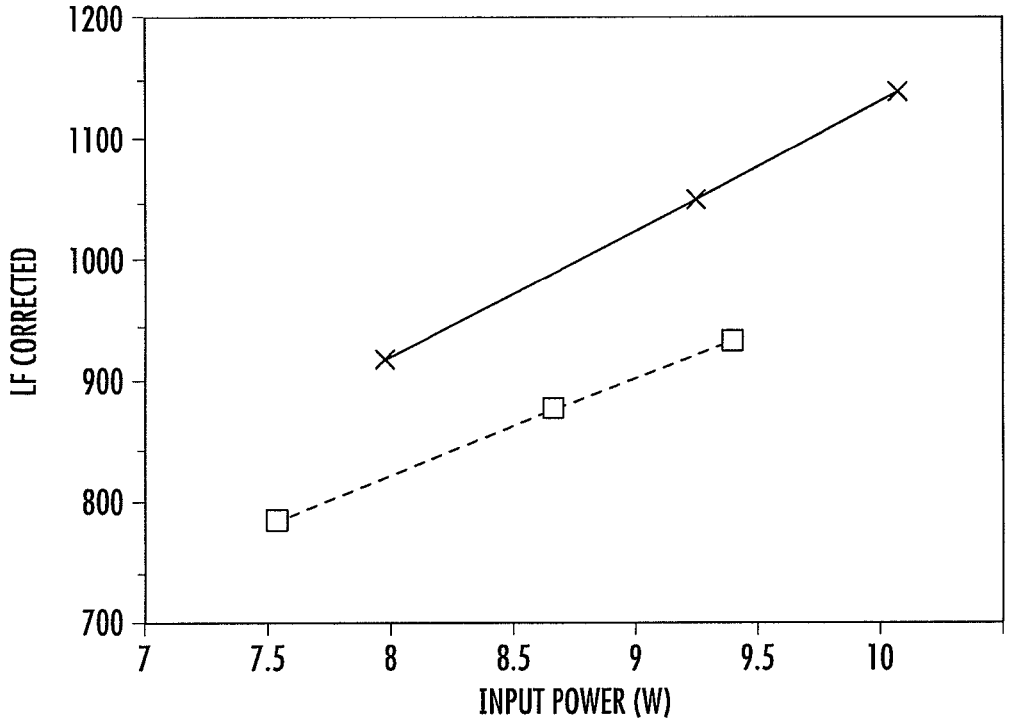
FIG. 9 is a graph lumen flux of an embodiment of an embodiment the lamp of the invention.

FIG. 9 shows the luminous flux of a lamp incorporating elements of the present invention for given DC input powers. The luminous flux of FIG. 9 is for a lamp comprising two LED strings with 14 LEDs mounted on each string, for a total LED count of 28. The LED strings are mounted in the same position as the LED strips 122 of the lamp 100 of FIG. 1. The luminous flux was measured both when the lamp received power (dashed line) and as a steady state (solid line) over five minutes. The CCT of the lamp emission was approximately 3200K, although this can range depending on factors such as the type of LED used. The relatively small difference between the instant-on and steady state measurements indicate that the thermal dissipation of the lamp is adequate and that the lamp and/or LEDs are operating at a reliable temperature.

Thermal modeling data from nine different lamps incorporating elements of the present invention are set forth in the chart below, along with the model parameters. The models showed measured maximum LED junction temperature (MaxTj) and average LED junction temperature (AveTj) for LEDs with a 1.7 mm×1.7 mm footprint.

| Case # | # strings | # components | String width | Separation from wall | Base Orientation | Max Tj (° C.) | Ave Tj (° C.) |
|---|---|---|---|---|---|---|---|
| 1 | 2 | 24 | 3 mm | 0 mm | Up | 86.0 | 83.4 |
| 2 | 2 | 24 | 3 mm | 0 mm | Down | 87.4 | 84.8 |
| 3 | 2 | 24 | 3 mm | 0.1 mm | Up | 92.0 | 87.7 |
| 4 | 2 | 24 | 3 mm | 0.3 mm | Up | 105.8 | 103.0 |
| 5 | 2 | 24 | 3 mm | 1 mm | Up | 128.7 | 125.9 |
| 6 | 2 | 24 | 1.7 mm | 1 mm | Up | 149.6 | 145.8 |
| 7 | 2 | 24 | 5 mm | 1 mm | Up | 111.6 | 109.5 |
| 8 | 3 | 36 | 3 mm | 0.3 mm | Up | 86.7 | 85.2 |
| 9 | 2 | 36 | 3 mm | 0.3 mm | Up | 105.1 | 102.4 |

Parameters:
Total power: 8.5 W
Heat power: 70% of total power
Components thermal resistance (7.5° C./W)
Glass globe (0.78 W/mK), 1 mm thick
LEDs mounted on copper ribbons (386 W/mK), 6 mil thick
Solid plastic base (molded ABS, 0.153 W/mK)
Sealed fluid air inside of glass
Open environment of fluid air outside of lamp at 25° ambient Thermal simulation images of the lamp assembled in accordance with test case 4 set forth above show that while the areas of the enclosure 112 adjacent to the LED strings are hotter than other areas of the enclosure, other areas of the enclosure 112 are clearly hotter than the ambient temperature of 25° C., indicating that the enclosure 112 is serving as a heat sink that is sufficient for steady state operation of the lamp.

Figure 8:
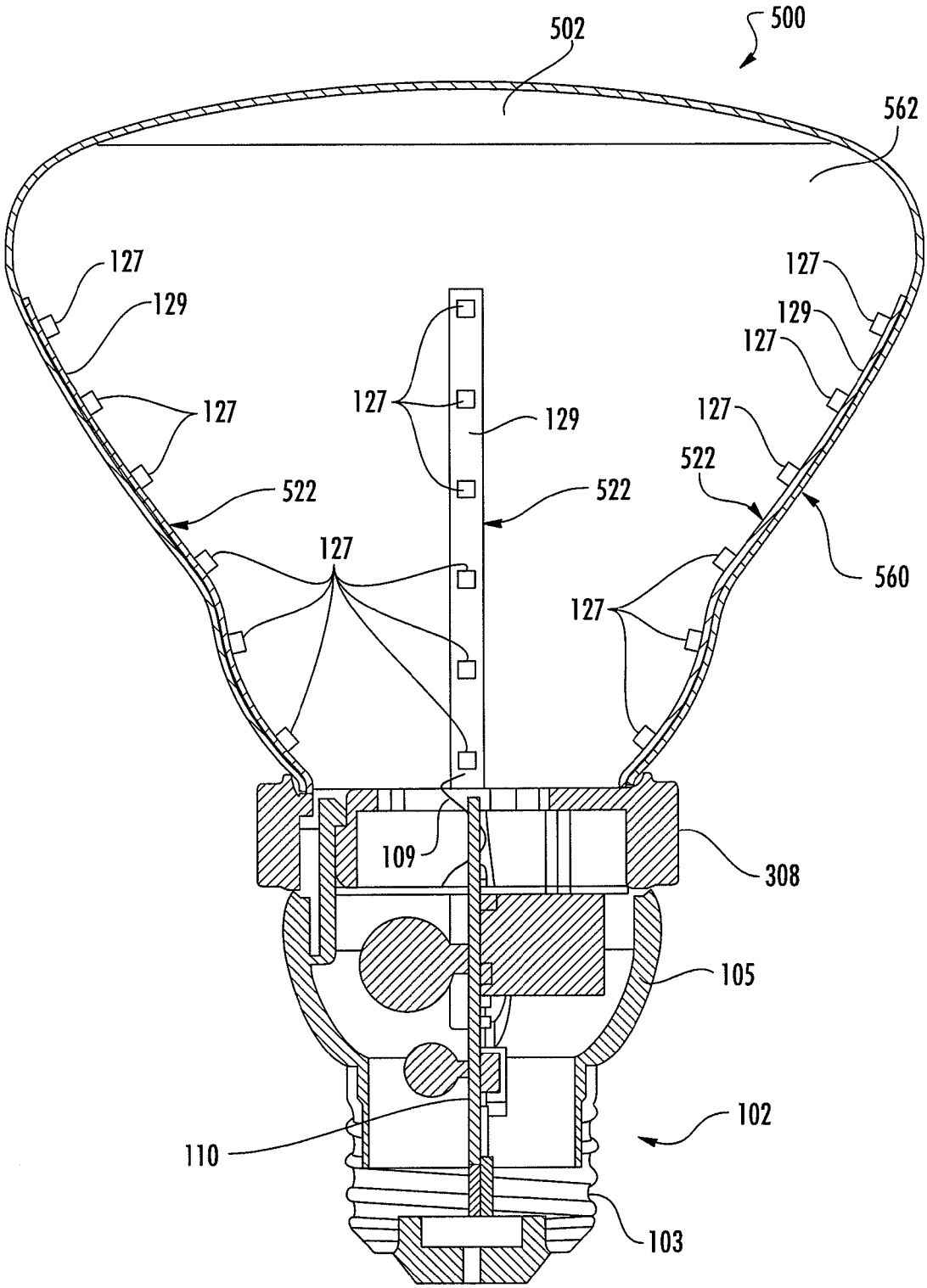
FIG. 8 is a section view of another embodiment of the lamp of the invention.

In other embodiments of the lamp, a directional lamp 500 may be provided that may be used as a replacement for an incandescent directional bulb such as BR bulb, such as a BR30 or similar bulb, a PAR bulb or other similar reflector bulb as shown in FIG. 8. The lamp 500 of the invention includes a base 102 that may comprise an Edison connector 103 and a housing 105 as previously described. The enclosure 560 may be connected to base 102. Enclosure 560 may comprise a reflective interior surface 562 that reflects light in a desired pattern. The reflective surface 562 may be a parabolic reflector such as found in a PAR style bulb for reflecting the light in a relatively tight pattern or the reflective surface 562 may have other shapes such as conical or facted for reflecting the light in a wider pattern such as may be found in a BR style bulb. Further, the reflective surface 562 may be formed on the enclosure 560 or it may be formed as a separate component inside of the enclosure. The reflective surface 562 may be an opaque plastic component made of reflective white material or it may be a specular surface. The reflective surface 562 may also be formed on the inside of a transparent plastic or glass enclosure and may be for example be made of a reflective aluminum layer. In a reflector lamp such as a PAR or BR style lamp the LEDs 127 direct light inwardly where the interior reflective surface of the enclosure reflects at least a portion of the light emitted by the LEDs 127 in the desired pattern out of exit surface 502. Numerous configurations of both standard and non-standard lamps may be provided. Other constructions of the reflective surface and enclosure are possible.

A plurality of LED strings 522 may be provided inside of the enclosure 560 where each of the strings comprising a ribbon 129 supporting a plurality of LEDs 127 as previously described. The LED strings may extend along the wall of the enclosure. In a reflector lamp the LED strings may terminate short of the distal end of the enclosure 560 such that the light is directed primarily toward the reflective surface 562 where the LED strings do not cross the exit surface 502. The LED strings may be thermally coupled to a heat sink 308 such that heat from the LEDs is dissipated both through the enclosure and via the heat sink. The LED strings may be thermally coupled to the heat sink 308 by direct physical contact between the heat sink and the LED strings. Alternatively thermally conductive elements may be disposed between the heat sink and the LED string to thermally couple these elements.

With respect to the features described above with various example embodiments of a lamp, the features can be combined in various ways. The LEDs 127 may comprise an LED die disposed in an encapsulant such as silicone, and LEDs which may be encapsulated with a phosphor to provide local wavelength conversion. A wide variety of LEDs and combinations of LEDs may be used in as described herein. The LEDs 127 are operable to emit light when energized through an electrical connection. For example, the various methods of including phosphor in the lamp can be combined and any of those methods can be combined with the use of various types of LED arrangements such as bare die vs. encapsulated or packaged LED devices. The embodiments shown herein are examples only, shown and described to be illustrative of various design options for a lamp with an LED array.

LEDs and/or LED packages used with an embodiment of the invention and can include light emitting diode chips that emit hues of light that, when mixed, are perceived in combination as white light. Phosphors can be used as described to add yet other colors of light by wavelength conversion. For example, blue or violet LEDs can be used with the appropriate phosphor. LED devices can be used with phosphorized coatings packaged locally with the LEDs or with a phosphor coating the LED die as previously described. For example, blue-shifted yellow (BSY) LED devices, which typically include a local phosphor, can be used with a red phosphor to create substantially white light, or combined with red emitting LED devices in the array to create substantially white light. A lighting system using the combination of BSY and red LED devices referred to above to make substantially white light can be referred to as a BSY plus red or "BSY+R" system. In such a system, the LED devices used include LEDs operable to emit light of two different colors. A further detailed example of using groups of LEDs emitting light of different wavelengths to produce substantially while light can be found in issued U.S. Pat. No. 7,213,940, which is incorporated herein by reference.

In some embodiments, the LEDs may be placed approximately equidistant from one another on the ribbon, although in other embodiments the LEDs are not placed equidistant from one another. Further, in one embodiment an additional LED 127 is provided at the junction of the LED strings 222 (corresponding to the top of the lamp at the distal end of enclosure 112).

In one embodiment, the enclosure 112 and base 102 are dimensioned to be a replacement for an ANSI standard A19 bulb such that the dimensions of the lamp 100 fall within the ANSI standards for an A19 bulb. The dimensions may be different for other ANSI standards including, but not limited to, A series bulbs such as A21 and A23 standards. In other embodiments the lamp may configured to be a replacement for standard PAR, Br bulbs or other standard incandescent bulbs. In some embodiments, the LED lamp 100 may be equivalent to standard watt incandescent light bulbs. However, the form factor of the lamp and the light output may be different than standard bulb configurations.

While in some embodiments the ribbons are evenly spaced about the periphery of the enclosure 112, 560 the ribbons need not be evenly spaced. The sets of LEDs 127 are arranged such that the light emitted from each set of LEDs overlaps with the light emitted from the other sets of LEDs. As a result, while each set of LEDs is arranged to project light over a portion of the enclosure the light from the sets of LEDs overlaps to a large degree. While lamps with one two and three strings of LEDs are shown, a greater or fewer number of strings and associated LEDs may be used. The LEDs may be arranged in a variety of patterns on the ribbons 129 relative to the enclosure. A wide variety of shapes and sizes of the ribbon 129 and LEDs 127 may be used. The number of ribbons, their placement and the number and locations of the LEDs are selected to develop a desired light pattern for a desired lamp configuration and may vary from that shown in the figures. The number of LEDs may be increased or decreased from that shown in the figures to change the luminosity and/or color output of the lamp, for power or heat considerations or for other reasons. Further, the arrangement of the ribbons 129, and the corresponding arrangement of the LEDs 127 within the enclosure may be varied to create different light patterns for different types of lamps.

The ribbon 129 is made of a thermally conductive material such that heat generated by the LEDs 127 is transferred to the enclosure 112 via the ribbon. Because the LEDs 127 are thermally coupled to the ribbon 129 and the ribbon is thermally coupled to the enclosure 112, heat is transferred from the LEDs to the exterior of the bulb via the ribbons 129 and enclosure 112 over a short thermal path. In some embodiments, the ribbon 129 can comprise a reflective coating, surface, layer and/or element on the mounting surface for the LEDs 127 that faces the interior of the enclosure 112. The ribbon 129 comprises the mounting surface for the LEDs 127 where the LEDs are mounted on one surface of the ribbon. The LEDs 127 may be mounted directly to the ribbon 129 where "mounted directly to the substrate" means that the LEDs are mounted directly to the ribbon that forms the heat sink without any intervening elements or components other than the connection mechanism used to accomplish the mount such as solder, thermal adhesive or the like.

In one embodiment the ribbon 129 is a relatively thin, planar member made of a relatively pliant material such as aluminum, copper, flexible PCB, MCPCB or the like such that the substrate may be bent or otherwise deformed to have a desired shape. The ribbon may also be formed such as by a stamping process, or other process, where the shape of the ribbon is formed during fabrication of the substrate. The ribbon may be formed as a measured relatively stiff member where the ribbon is formed to have a shape that matches the interior surface of the enclosure such that the premade ribbon may be inserted into the enclosure where the shape of the ribbon corresponds to the shape of the enclosure. In one embodiment the ribbon may be bent along predetermined "score lines". The score lines may comprise thinned areas of the ribbon. By bending the ribbon 129 along the score lines the mounting areas on which the LEDs 127 are mounted remain planar. However, in other embodiments the ribbon may be bent more gradually over all or a large portion of the ribbon such that the bend of the ribbon is more gradual without sharp bend lines. The ribbon may be bent over its entire surface provided that the bending of the ribbon does not adversely affect the mechanical, thermal and electrical connection between the LEDs and the ribbon.

The ribbon 129 is formed into a three-dimensional shape that comprises portions that are shaped to conform to the shape of the enclosure 112 such that when the ribbon 129 is mounted within the enclosure 112 the ribbon 129 conforms to the interior surface of the enclosure 112. The LEDs on the ribbon 129 are disposed at the enclosure 112 and face generally toward the interior of the enclosure. A three-dimensional shape means that the substrate comprises mounting surfaces for the LEDs that are in more than one plane such that the LEDs are directed in more than one direction relative to the axis of the lamp.

Because the ribbon 129 follows the curvature of the enclosure, the LEDs 127 may be located on the substrate such that the LEDs face at various angles relative to the longitudinal axis of the lamp. As illustrated in the figures the ribbons 129 follow the general curvature of the enclosure 112 where the LEDs 127 located toward the distal end of the lamp may face somewhat toward the base 102 while the LEDs located near the base 102 of the lamp may face somewhat toward the distal end of the lamp. The center LEDs may face directly toward the longitudinal axis of the lamp. As a result, light may be directed by various ones of the LEDs toward the top, bottom or sides of the lamp to achieve a desired light pattern. While in the illustrated embodiment, the LEDs 127 are located on each of the ribbons in a similar location, the LEDs 127 may be located on the ribbons 129 in different locations on the ribbons such that the some of the LEDs may be disposed at more or less of an angle relative to the axis of the bulb than other ones of the LEDs to facilitate the generation of any suitable light pattern. Moreover, selected ones of the ribbons 129 may support a greater or fewer number of LEDs 127 than other ones of the ribbons.

The ribbon 129 may also comprise more than one piece. For example, the ribbon 129 may comprise a first portion and a second portion each supporting at least one LED 127. The ribbon portions may be mounted to the enclosure 112 separately and the electrical path may be connected from the base 102 to each ribbon portion individually or the ribbon portions may be connected in series.

The surface area of the ribbon 129 is selected such that the substrate is able to conduct sufficient heat away from the LEDs and disperse the heat to the ambient environment such that the performance of the LEDs is not degraded to an unacceptable level. The size of the substrate may be dictated by the heat generated by the LEDs, the number of LEDs used, the type of lamp, its use environment or the like.

To manufacture the lamp, a ribbon 129 made of a thermally conductive material such as aluminum is made in a desired shape as described above. The material may be pliable to facilitate the shaping of the ribbon. In one embodiment the electrical connection is formed as wire traces 130 on the substrate such as by using selective deposition technology to create the traces on a dialectric material, by using MCPCB's or the like. In other embodiments the electrical connection may be made of off the ribbon such as by using a separate conductor such as a wire. The LEDs are attached to the ribbon and are electrically connected to the electrical conductors on the ribbon. The substrate is bent or otherwise formed into the desired shape.

The ribbon 129 with the LEDs 127 is mounted to enclosure 112. The ribbon 129 may be mounted to the enclosure 112 in a variety of manners. The ribbon 129 may be attached to the enclosure by adhesive, welding, a mechanical connection, other methods or a combination of such methods. In one embodiment, the resiliency of the ribbon material may be used to hold the ribbons in position adjacent to or in contact with the interior surface of the enclosure 112. For example, the ends 129*a* of the ribbon may be attached to and supported on the base 102 or the heat sink 308. The ribbons may be deformed and inserted into the enclosure 112 through neck 115. When the ribbons are released the resiliency of the ribbon material biases the ribbons against or in close proximity to the interior surface of enclosure 112. Connectors may also be molded into or attached to the enclosure 112 which are engaged by mating connectors on the ribbon 129. For example, the enclosure 112 may comprise female receptacles or male engagement members that receive mating male engagement members or female receptacles formed on the ribbon 129. The engagement members may be retained in the receptacles by a friction fit, mechanical engagement, adhesive and/or the like.

In some embodiments the ribbons 129 may be formed into the desired shape externally of the enclosure and mounted to the enclosure, base or heat sink as previously described. In other embodiments, flexible ribbons may be located in the enclosure having adhesive or epoxy applied to the back or outer surfaces. An inflatable bladder may be inserted into the enclosure and inflated to force the adhesive side of the ribbons against the interior surface of the enclosure such that the ribbons are formed to the interior shape of the enclosure. The bladder may then be deflated and removed from the enclosure. The bladder may remain inflated until the adhesive cures. The inflatable bladder may be used with attachment mechanisms other than the adhesive or epoxy, such as the male/female connectors discussed above.

The ribbon 129 is mounted in the enclosure such that the back surface of the ribbon opposite to the mounting surface for the LEDs is exposed to the enclosure where it dissipates heat from the lamp. The ribbons 129 may be in direct contact with the interior surface of the enclosure 112 or the ribbons may be slightly spaced from the interior surface of the enclosure 112. Moreover, a thermally conductive material may be used between the ribbons and the interior surface of the enclosure 112 such as thermal epoxy, adhesive or the like.

The electrical connectors from the substrate, such as traces 130, are connected to the lamp electronics 110 in the base 102 via electrical conductors 109 such that an electrical path is created between the base and the LEDs. The base 102 may then be connected to the enclosure 112 and/or ribbon 129 to complete the lamp. The enclosure 112 may be secured to the base 102 or to the heat sink 308 using adhesive or a snap-fit connector such as elastic locking members.

Although specific embodiments have been illustrated and described herein, those of ordinary skill in the art appreciate that any arrangement, which is calculated to achieve the same purpose, may be substituted for the specific embodiments shown and that the invention has other applications in other environments. This application is intended to cover any adaptations or variations of the present invention. The following claims are in no way intended to limit the scope of the invention to the specific embodiments described herein.

The invention claimed is:

1. A LED lamp comprising:

an enclosure comprising an optically transmissive portion having an interior surface and defining a completely enclosed interior space;

a base connected to the enclosure;

a plurality of LEDs mounted on a thermally conductive ribbon for emitting light when energized through an electrical path from the base, wherein the ribbon is in the electrical path to the plurality of LEDs, the plurality of LEDs being disposed near the interior surface of the optically transmissive portion of the enclosure and positioned to direct light primarily inwardly toward a center of the enclosure, wherein the plurality of LEDs are disposed about the periphery of the enclosure, the ribbon having a surface that is disposed adjacent to the interior surface of the optically transmissive portion of the enclosure for transmitting heat from the plurality of LEDs to the enclosure.

2. The lamp of claim 1 wherein the base comprises an Edison base.

3. The lamp of claim 1 further comprising a plurality of ribbons each of the plurality of ribbons supporting a plurality of LEDs and being in the electrical path to the plurality of LEDs.

4. The lamp of claim 1 wherein the plurality of LEDs are mounted on a mounting surface of the ribbon, and the surface of the ribbon and the mounting surface are part of the same physical component.

5. The lamp of claim 1 wherein the plurality of LEDs are mounted directly to the ribbon.

6. The lamp of claim 1 wherein the outer dimensions of the lamp fall within the ANSI standards for an A series bulb.

7. The lamp of claim 1 wherein electrical conductors for providing current to the plurality of LEDs are formed on the ribbon.

8. The lamp of claim 1 wherein the ribbon comprises one of aluminum board, flexible PCB, lead frame, PCB and MCPCB.

9. The lamp of claim 1 wherein the ribbon is formed into a three-dimensional shape that comprises portions that are shaped to conform to the shape of the interior surface of the enclosure.

10. The lamp of claim 9 wherein the ribbon is bent along score lines.

11. The lamp of claim 1 wherein the plurality of LEDs are oriented at different angles relative to a longitudinal axis of the lamp.

12. The lamp of claim 1 wherein a power supply is located in the base.

13. The lamp of claim 1 further comprising a tower that extends into the enclosure for supporting a second plurality of LEDs.

14. The lamp of claim 13 wherein the tower forms part of a heat sink for dissipating heat from the second plurality of LEDs.

15. The lamp of claim 14 wherein the heat sink extends at least partially outside of the lamp.

16. The lamp of claim 15 wherein the heat sink is thermally coupled to the plurality of LEDs for dissipating heat from the plurality of LEDs.

17. The lamp of claim 1 further comprising a heat sink for supporting a second plurality of LEDs adjacent an opening into the enclosure.

18. A LED lamp comprising:

an enclosure that is at least partially optically transmissive and comprises an interior surface having a shape;

a base connected to the enclosure and a tower that extends from the base into the center of the enclosure;

a plurality of LEDs mounted on a first surface of a thermally conductive ribbon for emitting light when energized through an electrical path from the base, the ribbon having a second surface that is disposed adjacent to the interior surface of the enclosure for transmitting heat from the plurality of LEDs to the enclosure wherein the second surface conforms to the shape of the interior surface over the length of the ribbon and at least one LED mounted on the tower where the at least one LED is spaced internally of the conductive ribbon.

* * * * *